United States Patent [19]

Nilsson

[11] 3,992,913

[45] Nov. 23, 1976

[54] PRESS FOR HYDROSTATIC EXTRUSION OF TUBES

[75] Inventor: Jan Nilsson, Robertsfors, Sweden

[73] Assignee: Allmanna Svenska Elektriska Aktiebolaget, Vasteras, Sweden

[22] Filed: May 22, 1975

[21] Appl. No.: 580,462

[30] Foreign Application Priority Data

June 7, 1974 Sweden ..... 7407508

[52] U.S. Cl. ..... 72/60; 72/264

[51] Int. Cl.[2] ..... B21C 25/04

[58] Field of Search ..... 72/60, 264, 56, 462, 72/481, 370

[56] References Cited

UNITED STATES PATENTS

| | | | |
|---|---|---|---|
| 1,285,328 | 11/1918 | Neuberth | 72/264 X |
| 3,178,920 | 4/1965 | Buffet | 72/264 X |
| 3,751,958 | 8/1973 | Nilsson et al. | 72/60 |

*Primary Examiner*—Milton S. Mehr
*Attorney, Agent, or Firm*—Watson, Cole, Grindle & Watson

[57] ABSTRACT

A press for hydrostatic extrusion of tubes includes a die with an opening and a mandrel which together with the opening forms a gap in which a tubular billet is shaped into a tube. The mandrel is formed of a carrier with a bore therein and a tip which is attached in the bore and projects into the die opening. A plate is positioned between the inner end of the tip and the bottom of the bore and is made of a material with at least substantially the same E-modulus as the material of the carrier. The innermost end of the mandrel has an enlargement thereon forming a shoulder and the material of the character is compressed against the tip beneath the shoulder so as to prevent axial movement of the tip.

4 Claims, 1 Drawing Figure

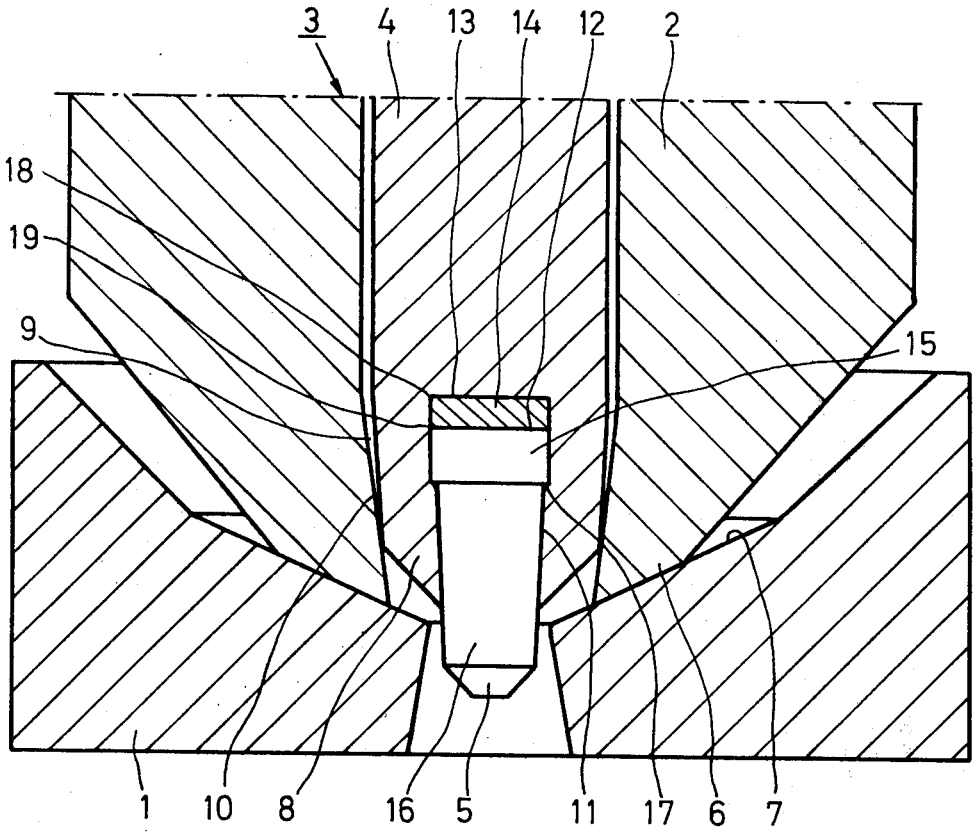
3
4
13
14
12
2
18
19
9
15
1
10
8
16
5
11
17
6
7

PRESS FOR HYDROSTATIC EXTRUSION OF TUBES

BACKGROUND OF THE INVENTION

The present invention relates to a press for hydrostatic extrusion of tubes. The press contains a pressure chamber which is composed of a high pressure cylinder, a pressure-generating punch insertable into one end of the cylinder and a die inserted into the other end of the cylinder. In the pressure chamber there is arranged a mandrel which is held axially fixed in relation to the die by support members. The tip of the mandrel projects into an opening in the die so that an annular gap is formed, in which a tubular billet is shaped into a tube with dimensions determined by the dimensions of the gap when the billet is subjected to a high all-sided hydrostatic pressure in a surrounding pressure medium. A press of this kind and its mode of operation is disclosed in greater detail in U.S. Pat. No. 3,751,958.

THE PRIOR ART

Particularly when extruding a heated billet the mandrel is subjected to very great stresses and the wear on the mandrel tip has caused considerable problems. It has been found to be technically difficult and expensive to make a whole mandrel of such materials as withstand both heat shocks and have such wear resistance that the mandrel has a sufficient life. The mandrel is therefore made in parts with a carrier of one material and a tip of a durable, heat-resistant material. The attachment of a mandrel tip of a material with a high E-modulus in a mandrel carrier of a material with a lower E-modulus, for example attaching a mandrel tip of hard metal or silicon nitride into a carrier of steel, has involved problems which are difficult to solve.

When attaching a tip into a bore in the mandrel carrier, the tip has broken at the interior part of the bore because of the fact that different compressions of the material give rise to stress concentrations.

SUMMARY OF THE INVENTION

The press according to the invention is characterised by the fact that the mandrel comprises a carrier with a bore, a tip which is attached in the bore and projects into the die opening, thus forming the gap which determines the dimensions of a tube, and a plate between the inner end of the mandrel tip and the bottom of the bore. This plate is made of a material having the same or approximately the same E-modulus as the material of the carrier. Suitably the mandrel carrier and the plate consist of the same material. The mandrel carrier is usually made of steel. The tip may be made of hard metal of silicon nitride.

BRIEF DESCRIPTION OF THE DRAWING

The invention is described in more detail with reference to the accompanying drawing which shows in cross-section the die end of a press embodying the invention.

DESCRIPTION OF THE PREFERRED EMBODIMENTS

In the drawing, 1 designates a die which is included in a pressure chamber, the rest of which is not shown, 2 is a tubular billet and 3 a mandrel comprising a mandrel carrier 4 and a mandrel tip 5. The units are shown in a position immediately prior to the beginning of the extrusion. The tip 6 of the billet 2 seals against the inlet cone 7 of the die. The front part 8 of the mandrel carrier 4 seals against the wall 10 of the hole 9. At the front part 8 of the mandrel carrier there is a bore 11 in which the mandrel tip 5 is attached. Between the inner end surface 12 of the mandrel tip and the bottom 13 of the bore 11 a plate 14 is inserted. This has the same diameter as the bore and the inner part 15 of the mandrel tip. The outer part 16 of the mandrel tip has a smaller diameter than the inner part 15, thus forming a shoulder 17. The tip part 16 may be made somewhat conical. The bore 11 has originally had the same diameter as the tip part 15. The front part 8 of the mandrel carrier, after insertion of the plate 14 and attaching of the mandrel tip 5, has been pressed against said tip 5 so that the part 8 of the mandrel carrier is permanently deformed and formed according to the front part 16 of the mandrel tip 5. Because of the diameter difference and the shoulder 17 thus formed, the mandrel tip is fixed axially in the mandrel carrier 4. The mandrel tip may be pressed or soldered into the carrier.

By mounting the plate between the rear end surface 12 of the mandrel tip 5 and the bottom 13 of the bore 11, the high stresses are eliminated at the recesses 18 formed by the different compression of the mandrel tip and mandrel carrier when the different parts have different E-moduluses. The stresses at the inner corner 19 of the mandrel 5 arising from the different compressions are less serious because of the smooth cylinder surface at this place.

For deformations of an elastic material the following applies according to Hookes' law:

$$\epsilon_x = \frac{\delta_x}{E} - \frac{\nu\delta_y}{E} - \frac{\nu\delta_z}{E}$$

The corresponding applies to $\epsilon_y$ and $\epsilon_z$.

$\epsilon_x$, $\epsilon_y$, $\epsilon_z$ indicate elongations in three directions perpendicular to each other.

$\delta_x$, $\delta_y$, $\delta_z$ indicate stresses in three directions perpendicular to each other.

$\nu$ is Poisson's ratio.

$E$ is the E-module of the material.

In a two-dimensional state of stress $\delta_x = \delta_y = -P$ and $\delta_z = 0$ and $$\epsilon_x = \epsilon_y = \frac{1-\nu}{E}(-P)$$

In a three-dimensional state of stress $\delta_x = \delta_y = \delta_z = -P$ and $$\epsilon_x = \epsilon_y = \epsilon_z = \frac{1-2\nu}{E}(-P)$$

In the latter case $E/1\text{-}2\nu$ is often equal to K, i.e. $\epsilon_x = \epsilon_y = \epsilon_z = (-P)/K$.

K is called "bulk modulus" in English. In Swedish K can be called "compression modulus". For $\nu = 0.5$, $K = \infty$. A material with $\nu = 0.5$ is incompressible.

For steel, $E \approx 200{,}000$ N/mm², $\nu = 0.3$ and $K \approx 500{,}000$ N/mm². When P = 10 kbar (1,000 N/mm²) the following numerical values apply, namely $$\epsilon_x = \epsilon_y = \epsilon_z = \frac{-10^3}{5 \cdot 10^5} = 2 \cdot 10^{-3} = 0.2\ \%.$$

For hard metal, $E \approx 600{,}000\ N/mm^2$, $\nu = 0.22$ and $K \approx 1{,}040{,}000$ $\epsilon_x = \epsilon_y = \epsilon_z = 0.096\%$.

At $\phi$ 25 mm, a difference in compression is obtained which is 25 (0.002 - 0.00096) = 0.026 mm.

This diameter may cause severe stresses in a recess, but in a cylindrical surface it will not cause any severe stresses.

In a two-dimensional state of strain the difference will be greater.

In the mandrel of this application it is a question of a two-dimensional state of strain rather than a three-dimensional state of strain, and a greater diameter reduction is thus obtained.

I claim:

1. Press for hydrostatic extrusion of tubes with a pressure chamber comprising a high pressure cylinder, a pressure generating punch insertable into the cylinder, a die arranged in the cylinder and a mandrel axially fixed in relation to said die, said mandrel, together with an opening in the die, forming a gap in which a tubular billet is shaped into a tube when the billet is subjected to an all-sided hydrostatic pressure in a surrounding pressure medium, the mandrel comprising a carrier (4) with a bore (11), a tip (5) which is attached in the bore (11) and projects into the die opening and together with the die opening forms said gap, and a plate (14) between the inner end of the tip (5) and the bottom of the bore (11), said plate (14) being made of a material having at least approximately the same E-modulus as the material of the carrier (4).

2. Press according to claim 1, in which the tip (5) is made of hard metal and the carrier (4) and the plate (14) of steel.

3. Press according to claim 1, in which the tip (5) is made of silicon nitride and the carrier (4) and the plate (14) of steel.

4. Press according to claim 1, in which the part (15) of the mandrel tip (5) projecting farthest into the bore has a larger diameter than the rest of the mandrel tip (5) and that the front part (8) of the mandrel carrier (4) is compressed against the mandrel tip (5) so that the mandrel tip is axially fixed in the mandrel carrier (4).

* * * * *